US008217312B2

(12) United States Patent
Venaas

(10) Patent No.: US 8,217,312 B2
(45) Date of Patent: Jul. 10, 2012

(54) METHOD AND DEVICE FOR HEATING A FLUID

(75) Inventor: Karl Venaas, Haslum (NO)

(73) Assignee: ALU Innovation AS, Trondheim (NO)

( * ) Notice: Subject to any disclaimer, the term of this patent is extended or adjusted under 35 U.S.C. 154(b) by 58 days.

(21) Appl. No.: 12/922,729

(22) PCT Filed: Mar. 24, 2009

(86) PCT No.: PCT/NO2009/000108

§ 371 (c)(1),
(2), (4) Date: Sep. 15, 2010

(87) PCT Pub. No.: WO2009/120089

PCT Pub. Date: Oct. 1, 2009

(65) Prior Publication Data

US 2011/0006052 A1 Jan. 13, 2011

(30) Foreign Application Priority Data

Mar. 27, 2008 (NO) ..... 20081495
Apr. 18, 2008 (NO) ..... 20081871

(51) Int. Cl.
*H05B 7/18* (2006.01)
*F27D 11/10* (2006.01)

(52) U.S. Cl. ..... 219/383; 219/384; 432/252; 432/254.2; 373/60; 373/71; 373/72; 373/108

(58) Field of Classification Search ..... 219/383, 219/384; 373/60, 71, 72, 108; 432/252, 432/254.2

See application file for complete search history.

(56) References Cited

U.S. PATENT DOCUMENTS 5,255,284 A 10/1993 Meredith

FOREIGN PATENT DOCUMENTS

WO 2004076699 9/2004

*Primary Examiner* — Shawntina Fuqua
(74) *Attorney, Agent, or Firm* — Dennison, Schultz & MacDonald

(57) ABSTRACT

Method for heating a fluid, in particular a fluid which is not electrical conductive, where a rotor body (10) which is arranged in a chamber for absorption of the fluid, is rotated with a generally vertical shaft (11). A voltage is applied to a rod shaped electrode (16) which is arranged centrally in a rotor chamber (12) and to an electrode at the bottom (13) of the rotor chamber, for creation of a flame arc, so that a flow of the fluid passing the flame arc is created. The length (L) of the flame arc is held generally stable, preferably constant by controlling the position of the rod shaped electrode (16). The fluid is made enter the rotor chamber (12) so that it is kept outside the flame arc, and that the fluid is provided to flow through the rotor chamber (12).

13 Claims, 2 Drawing Sheets

METHOD AND DEVICE FOR HEATING A FLUID

BACKGROUND OF THE INVENTION

The invention relates to a method for heating a fluid by maintaining a flame arc in a rotor which is, at least partly, immersed in the fluid. Further it comprises a device used to carry out this method. "Fluid" is used to comprise all liquids, gases and particles and mixtures of these which may be pumped and transported to and from a container where the device is arranged.

DESCRIPTION OF RELATED ART

From Norwegian patent 154498 it is known a device for heating liquid metal with a flame arc which is created between a fixed, axially positioned electrode and liquid metal. This device cannot be used for heating liquids without electrical conductance, and does not give satisfactory possibility for control of the output.

From Norwegian patent 318848 it is known a device for heating liquid metal, where in a container with a cover with openings for delivery and removal of liquid metal a rotor in the form of a hollow rotational body is arranged, and with a tubular shaft which accommodates a rod shaped electrode for delivery of electrical power for forming a flame arc towards the surface of the metal and where the tubular drive shaft is arranged for delivery of gas to the liquid metal.

The end of the rod shaped electrode is arranged in a hollow rotor with opening facing the bottom of the container. The rotor is arranged to provide a surface of the liquid metal, so that the flame arc is formed inside the rotor, towards the liquid metal.

A weakness related to this device is that it may only be used for fluids which are electrically conductive.

From the U.S. Pat. No. 5,255,25 (Meredith 1993) it is known a flame arc furnace with a rod electrode and a bottom electrode which forms a part of the bottom of the flame arc furnace. This furnace has not been used in connection with rotor electrodes and is difficult to adapt for such purposes.

SUMMARY OF THE INVENTION

The main purpose of the invention therefore is to make an improvement of the known method, which may be used for heating of liquids with low or no electrical conductivity. Consequently there is a need for a method which is suited for heating of water, melted slag, organic liquids and the like. The invention may also be used for heating of air and other gases.

Further it is a purpose to create a device for carrying out this method. This device should be reliable and adaptable for heating of different fluids and it should be possible to control the output.

Further purposes related to the invention will appear from the description of example embodiments.

The substantial novelty of the method of the invention is that a heating of a fluid occurs, in particular a fluid which does not have electrical conductivity, where a rotor body which is arranged in a chamber for absorbing the fluid is set into rotation by a generally vertical shaft, and where a voltage is applied to a rod shaped electrode which is arranged centrally in a rotor chamber and to an electrode at the bottom of the rotor chamber, for creating a flame arc, and where a current of the fluid past the flame arc is created, where the length of the flame arc is kept generally constant by controlling the position of the rod shaped electrode and the fluid is entered into the rotor chamber outside the flame arc, and that the fluid is brought to flow through the rotor chamber.

By this method it is possible to perform heating of different liquids, included melted materials and gases. The effect which is produced by the flame arc is controlled by regulating the voltage. By regulating the speed of the rotor it becomes possible to adapt the surface of the fluid against the flame arc and in this way make the transfer of heat optimal.

The method may be implemented particularly effectively for gases, if the fluid is pumped axially into the rotor chamber.

The invention also comprises a device for implementing this method, as described in claim 3. This device is used in a chamber to accommodate a fluid which is to be warmed up. It has a rotor body placed in the chamber, while the rotor body has an inner rotor chamber with two electrodes for forming a flame arc by supplying energy to the fluid, the electrodes are connected to an electrical power supply. One electrode is rod shaped and placed generally vertical centrally in the rotor chamber and the other is a part of the bottom of the rotor chamber. The rod shaped electrode is provided to maintain a constant distance between the electrodes, while the electrode voltage is controlled in a known way. The rotor body is adapted for transferring the fluid through the rotor chamber, for example from the bottom end and passing the flame arc at a certain distance from this, and has in one embodiment openings for discharge of heated fluid.

With this device one can with small changes utilize equipment which is designed and tested in connection with liquid metal.

The invention may be used with fluids that is electrical conductive and fluids that are close to electrical insulators. In addition to liquid metal, it is suited for water, melted slag, melted salt, organic liquids and gases.

BRIEF DESCRIPTION OF THE DRAWINGS

The invention will in the following be described with reference to the drawings wherein.

DESCRIPTION OF THE PREFERRED EMBODIMENTS

Figure 1:
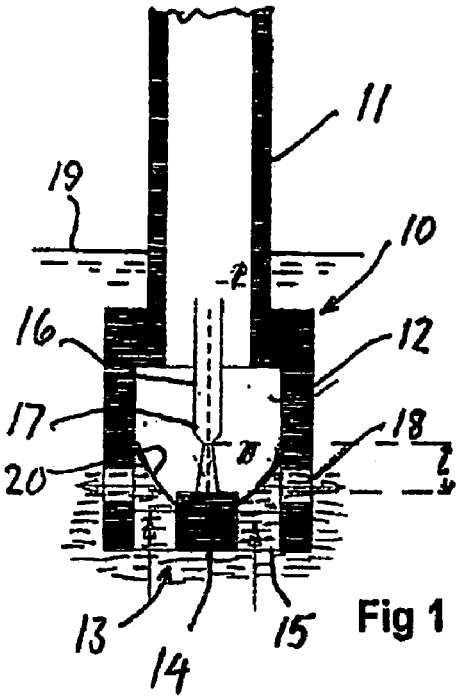
FIG. 1 shows an axial sectional view through one embodiment of the central rotor part of a device according to the invention.
Figure 2:
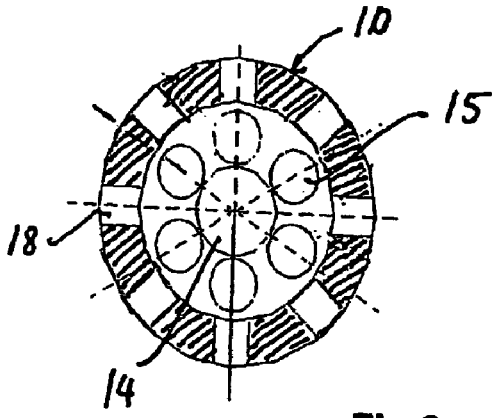
FIG. 2 shows a horizontal sectional view through the rotor part in FIG. 1, over the bottom part.

FIG. 1 shows a circle symmetric metallic rotor body 10 which is carried by a tubular shaft 11 with a common vertical axis. The shaft 11 is connected to a known drive gear and may be adapted for elevation and lowering relatively to a surrounding chamber (not shown). The shaft 11 is tubular for supply of gas, liquid and/or particles, to the chamber incorporating the rotor.

Thus the rotor body 10 is arranged to be arranged in a chamber, for example a melting furnace or hot water container. In the shown example the rotor body 10 has an inner concentric chamber 12 which is closed downwards with a bottom wall 13. The bottom wall 13 has a central hub electrode 14 which is surrounded by an annular series of axial holes 15, in the shown embodiment six holes, which are evenly distributed along the periphery.

The holes 15 may also have an oblique position, possibly also helical, to create a pumping effect during rotation.

In the rotor body 10 a centrally positioned electrical conducting and tubular electrode 16 is arranged. The tubular electrode 16 is suspended in a suitable way together with the rotor body 10. Besides it is suspended in such at way that its axial position in relation to the central hub electrode 14 may be adjusted with appropriate means. In this way the distance L between the bottom wall 13 and the end of the electrode 17 may be maintained constant. This means may comprise a displacement mechanism, which for example may comprise a linear motor and a controlling circuit for activating the displacement mechanism. This may be based on prior art electromechanics and control technology.

The electrode 16 and its counter electrode, the rotor body 10 are in a known way connected to each pole of a power supply, either direct current or alternating current. The voltage may, in a known manner, be controlled. The electrode 16 may be cooled, for example by water or another cooling liquid, based on prior art technology.

In addition to the openings 15 in the bottom wall 13, the walls of the rotor body have several side openings 18, in the example eight distributed along the periphery.

When operating the device according to the invention, the fluid to be warmed up, is elevated to a maximum level above the end of the electrode 17. In the example it is shown a level of the fluid 19 which is above the rotor chamber.

At the same time a pressure of gas is maintained inside the rotor chamber which pressure together with the centrifugal forces which is created during rotation maintains a level of the fluid 20, as a rotational paraboloid in the rotor chamber which keeps free the area over the central hub electrode 14 of the bottom wall and the end of the electrode. The shape of the rotational paraboloid is controlled by physical-mathematic conditions, and will by a given geometry be dependant of the rotational speed of the rotor.

Combined with the maintenance of a constant electrode distance L it will be prepared for the creation of a flame arc which may be controlled to provide a chosen output, independent of the fluid.

The flame arc may be started by that the rod shaped electrode 16 is moved to short circuit, so that the flame arc ignited. Thereafter it is removed to a predetermined distance and is maintained there under operation.

For each restart the electrode distance is readjusted to its usual distance.

The output that is produced may in a known manner be controlled by controlling the voltage over the electrodes, that is the central electrode 16 and the metallic rotor body 10. The power transmission is further controlled via control of the through-put of fluid through the rotor.

It is also possible to influence the effect transmission by changing the level 20 by regulating the rotor speed. This may at same time influence the pumping capacity.

The invention may be utilized for heating of different fluids, relatively independent of consistence and independent of conductivity. In addition to liquid metal it may be used for heating of water, organic liquids, melted slag, melted salt, gases and suspensions with liquids and powder.

The tube shaped electrode may be used for addition of gas and/or powder to the fluid which is heated.

Figure 3:
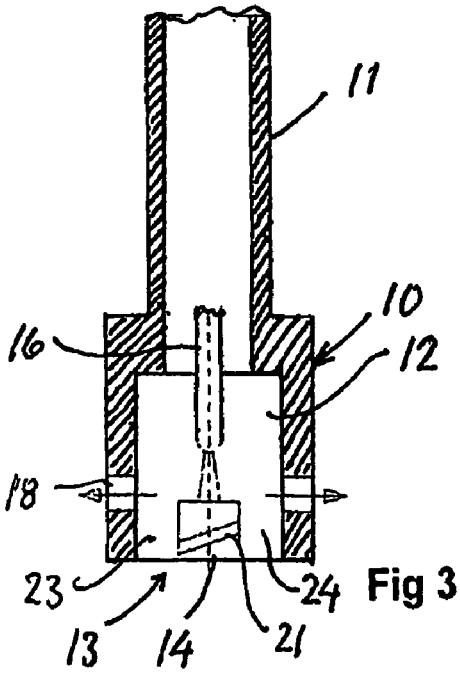
FIGS. 3 and 4 show a similar view of an alternative embodiment which provides pumping when the rotor body 10 is rotated.
Figure 4:
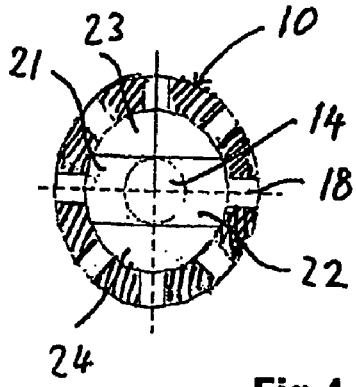

In the FIGS. 3 and 4 it is shown an alternative embodiment where the axial holes 15 in the bottom of the rotor 13 are replaced with a structure with a couple of oblique positioned wings 21, 22. The wings 21, 22 provide, during operation of the rotor, a pumping effect for transport of fluid to the rotor chamber 12, through the openings 23, 24 at the side of the wings. In this way the significance of the rotor speed with respect to control of the power transmission, is increased.

Figure 5:
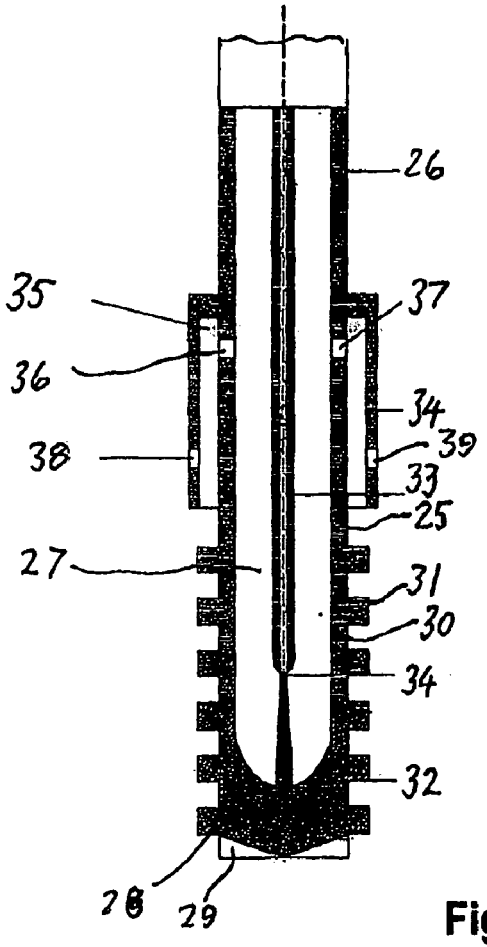
FIGS. 5 and 6 show an axial sectional view through two alternative embodiments of the invention.

FIG. 5 shows a circle symmetrical rotor body 25 which is carried by a tubular shaft 26 which is connected with a known drive gear and may be arranged for elevation and lowering. The shaft 26 is tubular for delivery of gases, liquids and/or particles.

The rotor body 25 is arranged for placement in a chamber, for example a melting furnace or a hot water container. In the example the rotor body 25 has an inner concentric chamber 27 which is closed downwards with a bottom wall 28. Outside the bottom wall 28 two or more radial and axial ribs 29 are arranged. The main purpose of these ribs is to create turbulence in the surrounding liquid, to improve the heat transfer.

From the sidewall 30 of the rotor body 25, in the lower part, a series of radial ring ribs 31 is projecting, which are integrated with the side wall 30. The ring ribs 31 increase the surface of the rotor body 25 and thereby increase the thermal conductivity.

In the bottom wall 28 an electrical conducting bottom element 32 is embedded.

In the rotor body 25 a centrally arranged conducting and tubular electrode 33, which forms a flame arc 34 towards the bottom element 32, is arranged. The tubular electrode 33 may be suspended in an appropriate way together with the rotor body 25. Thus is should be possible to control it axially, to allow adjustment of the flame arc 34. Further, outside the rotor body 25, it may be connected to a system for delivery of a gas or a liquid.

The electrical conductive element or bottom element 32 is in the example a carbon material or another conducting material. The bottom element 32 has in the example a dome shaped exposure surface towards the electrode 33.

Gas may be supplied to the rotor through the electrode 33 and via the tubular shaft 26. The vertical position of the electrode may be controlled. The current, which may be direct current or alternating current, is connected to the electrode 33 and the shaft 26.

Above the ring ribs 31 the rotor body 25 is surrounded by a tubular cap 34 facing downwards. This cap forms an annular chamber 35 communicating at the upper part through at least two radial holes 36, 37 in the wall of the rotor body. At the lowest part of the cap there are also at least two radial holes 38, 39 towards the surrounding media. In this way hot gas is conducted from the rotor chamber 27 and to the surrounding liquid. This gives a stirring effect and increases thereby the heat transmission effect.

In a modified version of the device in FIG. 5, the holes 36, 37 are omitted and similarly the cap. The delivery and carrying off of the fluid, for example a gas which is to be heated, will in this case take place through the rotor shaft.

Figure 6:
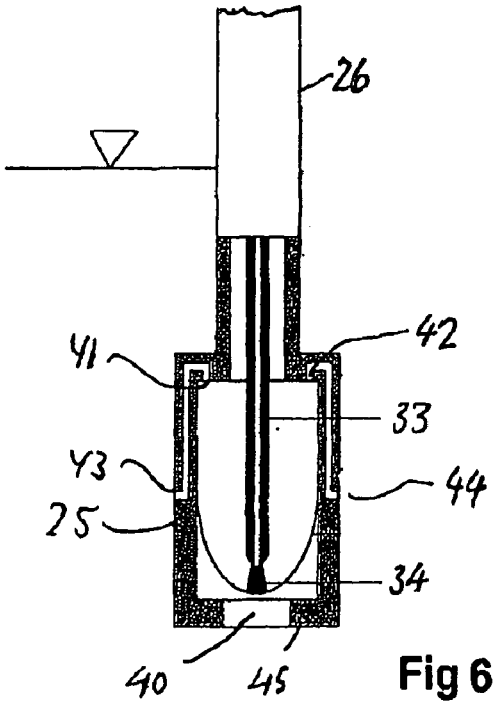

In FIG. 6 an additional embodiment is shown, which has some features in common with the embodiment in FIG. 1 as it has an opening 40 in the bottom of the rotor chamber, and a bottom ring 45 instead of a centrally bottom element. This may therefore mainly be utilized for heating of electrically conducting liquids, for example liquid metal. For outlet of heated gas to the liquid metal, it is arranged two inside outlet openings 41, 42 in the upper wall of the rotor chamber, with channels to the side openings 43, 44 outside the rotor chamber. Thereby heated gas is pressed out into the liquid metal.

The invention claimed is:

1. Method for heating a fluid, in particular a fluid which is not electrical conductive, where a rotor body (10) which is arranged in a chamber for absorption of the fluid, is rotated with a generally vertical shaft (11), and where a voltage is applied to a rod shaped electrode (16) which is arranged centrally in a rotor chamber (12) and to an electrode at the bottom (13) of the rotor chamber, for creation of a flame arc, and where it is created a flow of the fluid passing the flame arc, where the length (L) of the flame arc is held generally constant by controlling the position of the rod shaped electrode (16) and the fluid is provided to the rotor chamber (12) so that it is kept free of the flame arc, and that the fluid is brought to flow through the rotor chamber (12).

2. Method according to claim 1, characterized in that the fluid is pumped axially into the rotor chamber (12).

3. Device for implementing the method according to claim 1, with a chamber for accommodating a fluid which is to be warmed up, and with a rotor body (10) placed in the chamber, while the rotor body has an inner rotor chamber (12) with two electrodes (14,16) for the creation of a flame arc when applying energy to the fluid, the electrodes are connected to an electrical power source while one electrode (16) is rod shaped and placed generally vertical centrally in the rotor chamber (12) and the other, the central hub electrode (14) is a part of the bottom (13) of the rotor chamber, while electrical voltage is applied to the electrodes, characterized in that the rod shaped electrode (16) is arranged to maintain a generally stable, preferably constant distance between the electrodes, while the electrode voltage is controlled, the rotor body (10) is arranged for throughput of a fluid in the rotor chamber (12) passing the flame arc at a distance from this, and that the rotor body has an opening (18) for outlet of heated fluid.

4. Device according to claim 3, characterized in at least two openings (18) in side wall of the rotor chamber (12) for outlet of heated fluid.

5. Device according to claim 3, characterized in that the shaft (11) which carries the rotor body (10) has an opening towards the rotor chamber, and is arranged for outlet of fluid.

6. Device according to claim 3, characterized in that the electrode (16) is axially adjustable by a controlling circuit.

7. Device according to claim 3, characterized in that the bottom (13) of the rotor body has an annular series of axial holes (15).

8. Device according to claim 7, characterized in that the bottom of the rotor body has at least one wing (21, 22) in a oblique position, which during rotation has a pumping effect into the rotor chamber (12).

9. Device according to claim 4, characterized in that the bottom of the rotor chamber (12) is closed and that inlet and outlet of the fluid occurs through the shaft which carries the rotor chamber.

10. Device according to claim 3, characterized in that there at the bottom of the rotor chamber (12) is arranged a central hub electrode (14).

11. Device according to claim 4, characterized in that the openings (36, 37) in the side wall (25) of the rotor chamber are surrounded by a cap (34) which has an opening slit downwards.

12. Device according to claim 3, characterized in that the rotor chamber has at least two outlet openings (41, 42) in the upper part, preferably the upper end wall, with channels to outlet openings (43, 44) at the side of the rotor chamber.

13. Device according to claim 3, characterized in that the rotor chamber has a plurality of external ring ribs (31).

* * * * *